US008893933B2

(12) United States Patent
Ohshima

(10) Patent No.: US 8,893,933 B2
(45) Date of Patent: Nov. 25, 2014

(54) ACTUATOR-INVERTED CONSTANT-VOLUME EJECTION MECHANISM AND AEROSOL-TYPE PRODUCT PROVIDED WITH THE ACTUATOR-INVERTED CONSTANT-VOLUME EJECTION MECHANISM

(75) Inventor: Yasuo Ohshima, Tokyo (JP)

(73) Assignee: Mitani Valve Co., Ltd., Tokyo (JP)

( * ) Notice: Subject to any disclaimer, the term of this patent is extended or adjusted under 35 U.S.C. 154(b) by 0 days.

(21) Appl. No.: 13/821,848

(22) PCT Filed: Sep. 9, 2010

(86) PCT No.: PCT/JP2010/065546

§ 371 (c)(1),
(2), (4) Date: Mar. 8, 2013

(87) PCT Pub. No.: WO2012/032638

PCT Pub. Date: Mar. 15, 2012

(65) Prior Publication Data

US 2013/0175305 A1 Jul. 11, 2013

(51) Int. Cl.
*B05B 1/00* (2006.01)
*B65D 83/54* (2006.01)

(Continued)

(52) U.S. Cl.
CPC ..... *B65D 83/546* (2013.01); *B65D 83/206* (2013.01); *B65D 83/285* (2013.01);

(Continued)

(58) Field of Classification Search
CPC . A45D 34/00; A45D 34/04; A45D 2200/057; A45D 19/02; B65D 83/54; B65D 83/38; B65D 83/386; B65D 83/205; B65D 83/48; B65D 83/20; B65D 83/207; B65D 83/546; B65D 83/52; B65D 35/40; B65D 83/14; B05B 9/04
USPC ..... 222/402.13, 402.15, 653, 402.14, 222/402.2, 162
See application file for complete search history.

(56) References Cited

U.S. PATENT DOCUMENTS 3,093,857 A * 6/1963 Hersh ..... 401/190
4,252,455 A * 2/1981 de la Pena ..... 401/190

(Continued)

FOREIGN PATENT DOCUMENTS

JP 2001-180772 A 7/2001
JP 2003-299991 A 10/2003

(Continued)

*Primary Examiner* — Kevin P Shaver
*Assistant Examiner* — Michael J Melaragno
(74) *Attorney, Agent, or Firm* — Lucas & Mercanti, LLP

(57) ABSTRACT

Disclosed is an inverted constant-volume injection mechanism using an actuator which comprises a valve member (5), a movable member (6), a pressing-on operation member (7), and a pressing operation lever (8). On the basis of an operation by a user to hold a container main body and press the pressing-on operation member (7) onto the scalp (13) or a pressing operation by the pressing operation lever (8), first, output valves (5*a*, 7*d*) of the actuator art closed and a flow-in valve (4*b*) of a stem (4) is opened so that the content in the container main body flows into a constant amount chamber (A) defined between the flow-in valve (4*b*) to the output valves (5*a*, 7*d*). On the basis of a releasing operation performed thereafter, the stem (4) returns to a static mode position and the flow-in valve (4*b*) is closed, so that the content in the constant amount chamber (A) passes through the output valves (5*a*, 7*d*) which are opened by the effect of the liquefied gas, and is injected to the external space through a hole (7*c*) of the pressing-on operation member (7).

6 Claims, 6 Drawing Sheets

(51) Int. Cl.
*B65D 83/20* (2006.01)
*B65D 83/28* (2006.01)
*B65D 83/36* (2006.01)

(52) U.S. Cl.
CPC ..... *B65D 83/36* (2013.01); *B65D 83/54* (2013.01)
USPC ..... 222/402.13; 222/402.15; 222/402.14; 222/402.2; 222/162

(56) References Cited

U.S. PATENT DOCUMENTS

| | | | | | |
|---|---|---|---|---|---|
| 4,636,102 | A * | 1/1987 | Drake | 401/190 |
| 5,186,364 | A * | 2/1993 | Laszlo | 222/153.11 |
| 6,003,523 | A * | 12/1999 | Nettlefold | 132/290 |
| 6,196,276 | B1 * | 3/2001 | De Laforcade | 141/20 |
| 6,637,440 | B2 * | 10/2003 | de Laforcade | 132/112 |
| 6,877,924 | B1 * | 4/2005 | Mears et al. | 401/190 |
| 6,921,005 | B2 * | 7/2005 | Mizukawa et al. | 222/402.1 |
| 7,484,642 | B2 * | 2/2009 | Bonney | 222/256 |
| 7,658,338 | B2 * | 2/2010 | Matsumoto et al. | 239/337 |
| 8,479,752 | B2 * | 7/2013 | Duffield et al. | 134/104.2 |
| 8,631,975 | B2 * | 1/2014 | Lim | 222/256 |
| 2005/0236434 | A1 * | 10/2005 | Bonney | 222/386 |
| 2007/0068544 | A1 * | 3/2007 | Hackl et al. | 132/113 |
| 2008/0017672 | A1 * | 1/2008 | Ohshima | 222/402.1 |
| 2008/0167590 | A1 * | 7/2008 | Jon et al. | 601/160 |
| 2008/0196733 | A1 * | 8/2008 | Vena et al. | 132/202 |
| 2011/0315157 | A1 * | 12/2011 | Mercier | 132/112 |
| 2014/0064821 | A1 * | 3/2014 | Price et al. | 401/183 |

FOREIGN PATENT DOCUMENTS

| | | | | |
|---|---|---|---|---|
| JP | 2006-325981 | A | 12/2006 | |
| JP | 2007-204138 | A | 8/2007 | |
| JP | 2007204138 | A * | 8/2007 | B65D 83/40 |
| JP | 2007-320622 | A | 12/2007 | |
| JP | 2007-326647 | A | 12/2007 | |
| JP | 2008-081155 | A | 4/2008 | |
| JP | 2008081155 | A * | 4/2008 | B65D 83/40 |

* cited by examiner

ACTUATOR-INVERTED CONSTANT-VOLUME EJECTION MECHANISM AND AEROSOL-TYPE PRODUCT PROVIDED WITH THE ACTUATOR-INVERTED CONSTANT-VOLUME EJECTION MECHANISM

This patent application is a National Phase application of PCT/JP2010/065546 filed Sep. 9, 2010, the contents of which are incorporated herein by reference.

TECHNICAL FIELD

The present invention relates to an actuator-inverted constant-volume ejection mechanism of an aerosol-type product which uses liquefied gas or soluble compressed gas.

This actuator-inverted constant-volume ejection mechanism is of a type in which container body content (housing content) first flows into a space in a constant-volume chamber for storage therein as a constant-volume chamber outflow valve in an actuator closes and a constant-volume chamber inflow valve in a stem opens as a result of an ejecting action performed on an aerosol-type product, and the content of the constant-volume chamber is ejected into an external space through the constant-volume chamber outflow valve which has been set to an open state due to action of the liquefied gas or soluble compressed gas (or action of an elastic member) as the stem returns to a stationary mode position and the constant-volume chamber inflow valve closes subsequently.

In particular, the invention pertains to an actuator-inverted constant-volume ejection mechanism which ensures convenience in performing inverted constant-volume ejecting operation by means of an inverted constant-volume electing part which is provided with a longitudinal pressing member to be pressed against an ejection target area like the scalp, the longitudinal pressing member having a plurality of projections like needles of a needlepoint holder, as well as a lateral pushing member for driving the longitudinal pressing member in a pressing direction thereof.

In this Specification, the term "actuator" is used to mean a working part attached to a stem which acts to produce valve action of an aerosol container for ejecting content thereof into an external space.

For example, in an inverted constant-volume ejection mechanism of FIGS. 1 to 5, the entirety of a valve member 5, a movable member 6, a pressing member 7 and a pushing lever 8 corresponds to the "actuator."

Also, the terms "up/down (upward/downward)" and "longitudinal" are used to mean a lengthwise direction, or a longitudinal direction, of such a component as the stem or the actuator in individual Figures and the term "lateral" is used to mean a direction perpendicular to or at an oblique angle to an "up/down (upward/downward)" or "longitudinal" direction.

BACKGROUND ART

The applicant has already proposed actuator constant-volume ejection mechanisms of the aforementioned type, that is, actuator constant-volume ejection mechanisms of a type in which content of a container body is first flowed into and stored in a constant-volume chamber in a state where a constant-volume chamber outflow valve is closed as a result of constant-volume ejecting operation and the constant-volume chamber outflow valve is opened to eject the content of the constant-volume chamber into an external space subsequently (refer to Patent Documents 1 and 2).

As depicted in FIG. 6, the actuator constant-volume ejection mechanism of Patent Document 1 includes constituent elements, such as:

- a stem 21;
- a valve seat portion 22 (which corresponds to a valve member of this invention) attached to the stem 21;
- an operating button body 25 (which corresponds to a pressing member of this invention) disposed movably up and down with respect to a single-structured member including the stem 21 and the valve seat portion 22; and
- an operating button coil spring 23 provided between the valve seat portion 22 and the operating button body 25 for biasing the operating button body in an upward direction.

Then, an annular valve seat 24 of the valve seat portion 22 and an annular valve element 26 of the operating button body 25 together constitute a constant-volume chamber outflow valve.

In stationary mode in which the operating button, body 25 is not depressed, the constant-volume chamber outflow valve is kept open by an elastic force of the operating button coil spring 23.

Needless to say, a constant-volume chamber inflow valve (=a valve made up of a stem peripheral surface hole for passing the content and a conventionally known stem gasket for opening and closing the stem peripheral surface hole) of the stem 21 is closed by action of a conventionally known coil spring for the stem at this time.

Meanwhile, the coil spring for the stem and the stem gasket which are conventionally known are similar to a stem coil spring 10 and a stem gasket 11 of FIGS. 1 to 5.

When the operating button body 25 is depressed from a stationary mode position thereof, only the relevant button body first descends, overwhelming the elastic force of the operating button coil spring 23, whereby the constant-volume chamber outflow valve is closed.

After the constant-volume chamber outflow valve has closed, the stem 21, the valve seat portion 22 and the operating button body 25 forming a single structure, that is, with the constant-volume chamber outflow valve closed, descends and, then, the constant-volume chamber inflow valve opens so that the content of the container body flows into the constant-volume chamber for storage therein.

When a user stops depressing an operating button, the stem 21 ascends due to elastic action of the coil spring for the stem, thereby closing the constant-volume chamber inflow valve, and the operating button body 25 ascends (relative to the valve seat portion 22) due to elastic action of the operating button coil spring 23, thereby opening the constant-volume chamber outflow valve. Therefore, the only content of the constant-volume chamber is ejected into the external space.

After further studying and examining the above-described actuator constant-volume ejection mechanism and producing evaluation sets thereof, the applicant has verified that even if the operating button coil spring for biasing the operating button body is eliminated, the output valve or the constant-volume chamber is brought to an "open" state by a pressure of liquefied gas or soluble compressed gas within the constant-volume chamber, or the content of the constant-volume chamber is ejected into the external, space is a reliable fashion.

The actuator constant-volume ejection mechanism of Patent Document 2 which is based on the aforementioned verification is an actuator constant-volume ejection mechanism of a type configured by eliminating the operating button coil spring 23.

PRIOR ART DOCUMENTS

Patent Documents

Patent Document 1: Japanese Laid-open Patent Application No. 2003-299991

Patent Document 2: Japanese Laid-open Patent Application No. 2007-204138

The present invention is, so to speak, an extension of development of the above-described kind of actuator constant-volume ejection mechanism by the applicant that is based on an approach taken from a different point of view from the aforementioned point regarding whether or not the operating button coil spring 23 can be eliminated.

Specifically, it is an object of the invention to provide enhanced convenience in performing inverted constant-volume ejecting operation with an actuator-inverted constant-volume ejection mechanism provided with a needlepoint-holder-type pressing member which is pressed against an ejection target area like the scalp and movable along a longitudinal direction by adding a pushing member which is movable along a lateral direction for driving the longitudinal pressing member in a pressed direction thereof.

This object applies to both an actuator-inverted constant-volume ejection mechanism from which the operating button coil spring 23 is eliminated and an actuator-inverted constant-volume ejection mechanism provided with the operating button coil spring.

MEANS FOR SOLVING THE PROBLEM

The present invention solves the aforementioned problem in the below-described fashion.

(1) An actuator-inverted constant-volume ejection mechanism comprises a stem (e.g., a later-described stem 4) which serves a function of a constant-volume chamber inflow valve, the stem being biased by an elastic force in a first direction (e.g., an upward direction as illustrated in FIGS. 1 and 2) toward a stationary mode position in an aerosol container, a valve member which serves the function of a constant-volume chamber outflow valve, the valve member being fixed to the stem, a longitudinal pressing member (e.g., a later-described pressing member 7) attached to the valve member in such a manner that the longitudinal pressing member can move in the first direction and in a second direction (e.g., a downward direction as illustrated in FIGS. 1 and 2) which is opposite to the first direction, the longitudinal pressing member serving the function of the constant-volume chamber outflow valve together with the valve member, and the longitudinal pressing member having a plurality of projections (e.g., later-described projections 7*e*) like needles of a needlepoint holder that are pressed against an ejection target area (e.g., the later-described scalp 13), an ejection passage (e.g., a later-described passage 7*b*) to an external space and a constant-volume-chamber-forming cylindrical portion (e.g., a later-described movable member 6), a lateral pushing member (e.g., a later-described pushing lever 8) for driving the longitudinal pressing member in the second direction, a constant-volume chamber (e.g., a later-described constant-volume chamber A) defined by the stem, the valve member and the longitudinal pressing member for accommodating a content, a valve-action producing portion which is part of the stem constituting the constant-volume chamber inflow valve (e.g., a later-described lateral hole portion 4*b*) which shifts to an open state in which the content of a container body flows into the constant-volume chamber with the stem moving in the second direction, overwhelming the elastic force, as a result of an ejecting action performed on either of the longitudinal pressing member and the lateral pushing member, and is kept in a closed state by an effect of the elastic force biasing the stem in the first direction when the ejecting action is not performed on either of the longitudinal pressing member and the lateral pushing member, a valve-action producing portion located between the valve member and the longitudinal pressing member, the valve-action producing portion constituting the constant-volume chamber outflow valve (e.g., a later-described central truncated corneal portion 5*a* and circular edge portion 7*d*) which stays in a closed state as a result of a movement of the longitudinal pressing member in the second direction caused by the ejecting action performed on either of the longitudinal pressing member and the lateral pushing member, and shifts to an open state in which the content of the constant-volume chamber is caused to flow into the ejection passage by a force exerted on the longitudinal pressing member in the first direction after the ejecting action has been terminated.

(2) In (1) above, the longitudinal pressing member includes at least a pair of first cam-action producing portions (e.g., later-described driven parallelepipedic protrusions 6*e*) on a curved outside surface of the constant-volume-chamber-forming cylindrical portion, the pair of first cam-action producing portions being configured to be driven in the second direction as a result of a movement of the lateral pushing member caused by the ejecting action, and the lateral pushing member includes second cam-action producing portions formed in the form of at least a pair of arm portions (e.g., later-described straight arm portions 8*c*) that go into contact with the first cam-action producing portions when the ejecting action is performed.

(3) In (1) or (2) above, the ejection mechanism further comprises a shoulder cover (e.g., a later-described shoulder cover 9) which remains attached to the container body even when the ejecting action is performed, the shoulder cover including a guide portion (e.g., a later-described opening 9*c*, upright-position upper-side connecting portions 9*j*, and shelf-surface guide portion 9*k*) for guiding the lateral pushing member along a lateral direction when the ejecting action is performed.

(4) In one of (1) to (3) above, the force exerted on the longitudinal pressing member in the first direction is produced by a pressure of ejecting gas accommodated in the constant-volume chamber.

(5) In one of (1) to (4) above, the ejection mechanism further comprises a housing (e.g., a later-described stem coil spring 10) attached to the container body to serve as an upstream space of the constant-volume chamber inflow valve for accommodating a lower portion of the stem and a member for producing the elastic force (e.g., a later-described housing 3), the housing having an opening (e.g., a later-described cutout portion 3*a*) in a peripheral surface through which the content flows into the housing when the container is in an inverted position.

The actuator-inverted constant-volume ejection mechanism thus configured and an aerosol-type product provided with the actuator-inverted constant-volume ejection mechanism are subjects of the present invention.

ADVANTAGES OF THE INVENTION

The invention employs as an inverted constant-volume ejecting part not only a longitudinal pressing member which is pressed against an ejection target area like the scalp and movable along a longitudinal direction, the longitudinal pressing member having a plurality of projections like needles of a needlepoint holder, but also a lateral pushing member which is movable along a lateral direction for driving the longitudinal pressing member in a pressing direction thereof. Therefore, it is possible to ensure convenience in performing inverted constant-volume ejecting operation.

Even when the actuator-inverted constant-volume ejection mechanism is used in a state in which the ejection mechanism is lightly pressed against the scalp (=a state in which the stem is not sufficiently driven in the upward direction in the inverted position and the constant-volume chamber inflow valve is not fully opened), for example, the stem shifts to a state in which the constant-volume chamber inflow valve is sufficiently opened as in a case where the ejection mechanism is strongly pressed against the scalp if a user pushes the lateral pushing member inward.

BEST MODE FOR CARRYING OUT THE INVENTION

Figure 1:
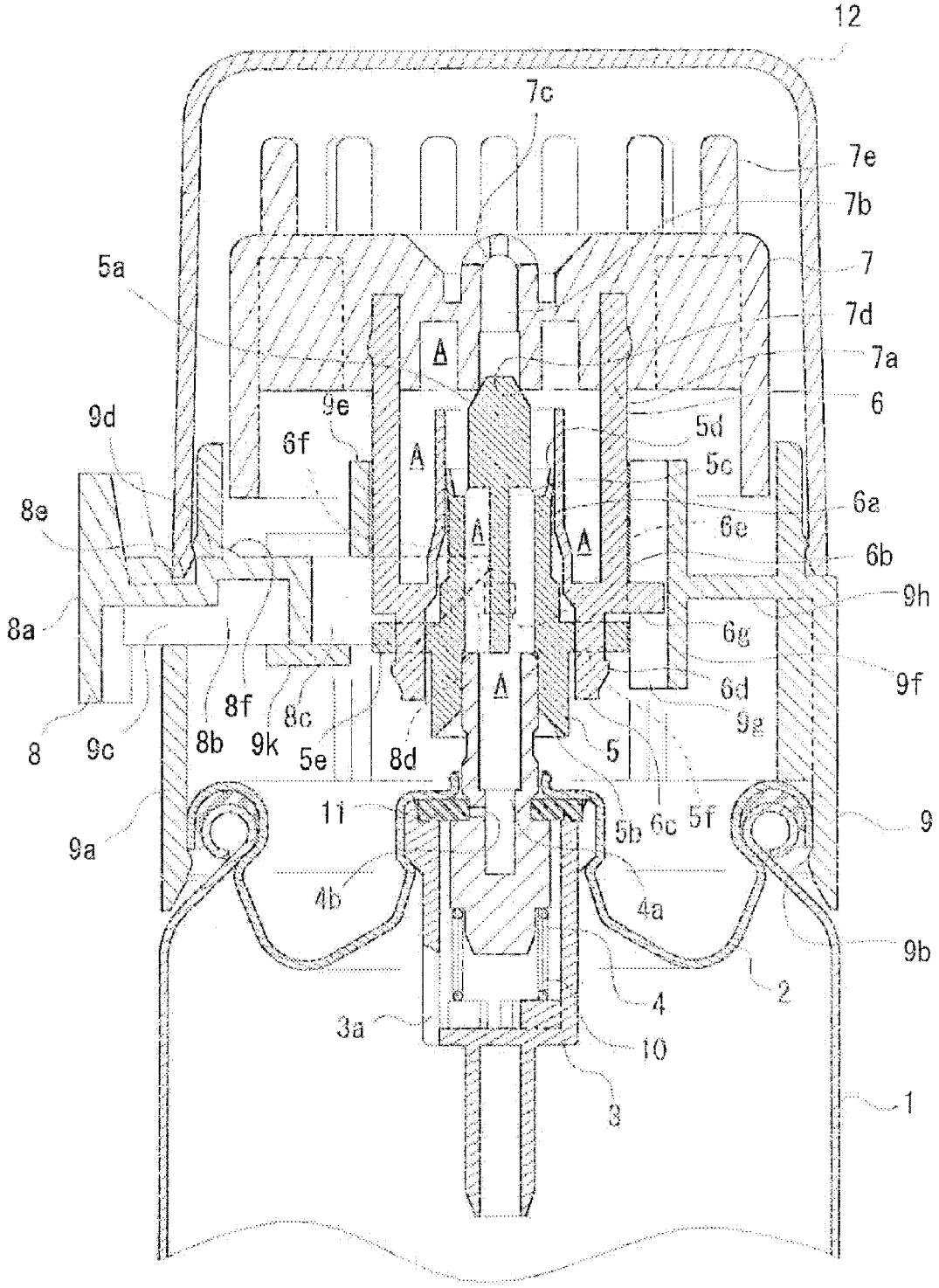
FIG. 1 is a representation of stationary mode (which is a state where at least a constant-volume chamber inflow valve is closed with neither an ejecting action in a longitudinal direction nor an ejecting action in a lateral direction performed) of an actuator-inverted constant-volume ejection mechanism.

As mentioned in the foregoing discussion, the present invention is directed to either of cases of an actuator-inverted constant-volume ejection mechanism which uses an operating button coil spring 23 and an actuator-inverted constant-volume ejection mechanism which does not use the operating button coil spring.

It should be noted however that, for the convenience of explanation, a description provided hereunder with reference to the drawings is in principle based on the assumption that the actuator-inverted constant-volume ejection mechanism is of type which does not use the operating button coil spring 23. Also, the following description is based on the assumption that liquefied gas is used as ejecting gas.

A best mode of carrying out the invention is now described with reference to FIGS. 1 to 5.

In the meantime, a constituent element (e.g., a cutout portion 3*a*) designated by a reference numeral associated with an alphabetical suffix hereinafter indicates that this element is in principle part of a constituent element (e.g., a housing 3) designated by an alphabetical portion of the reference numeral.

Figure 3:
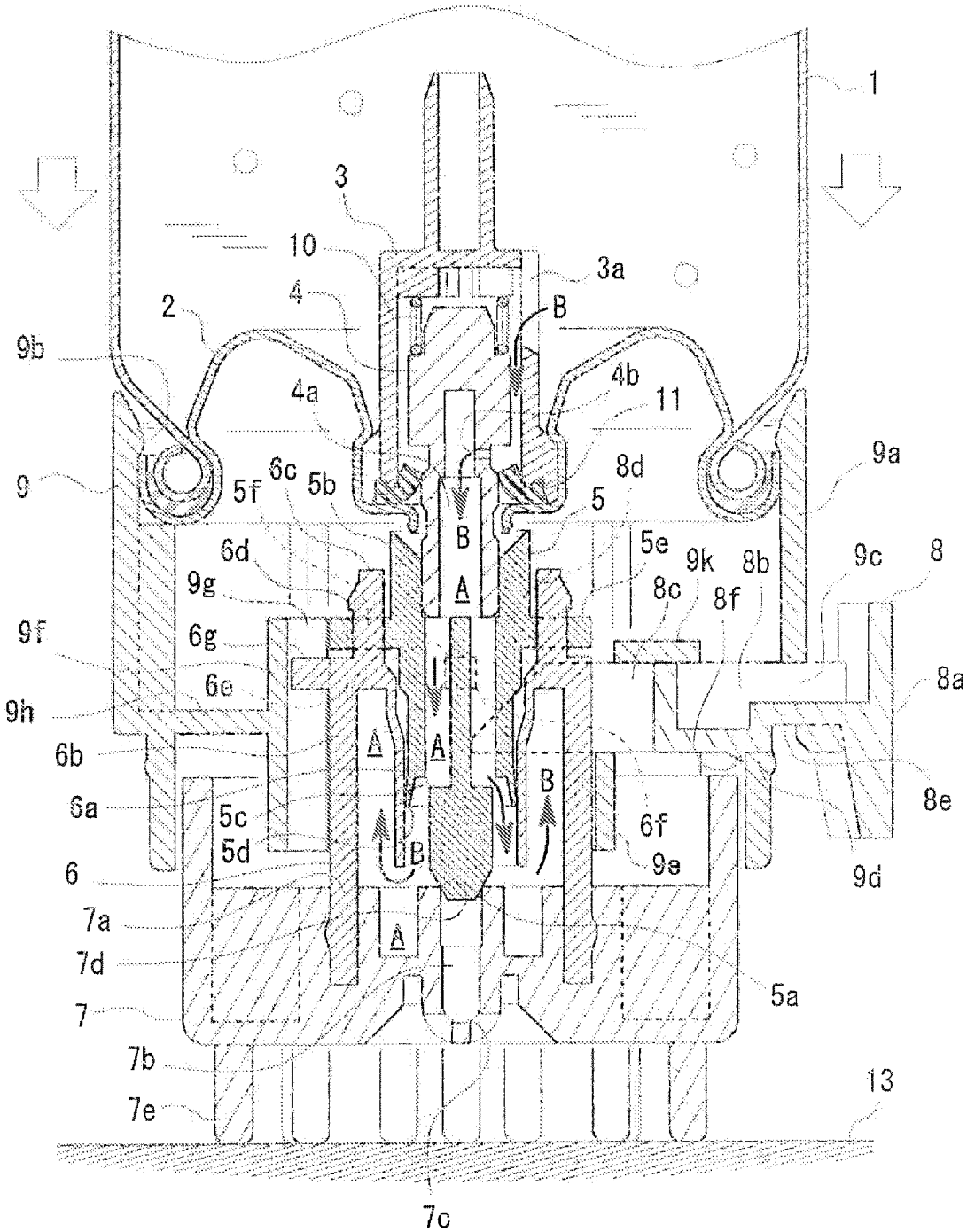
FIG. 3 is a representation of constant-volume chamber inflow mode first constant-volume chamber inflow mode which produces a state where the constant-volume chamber inflow valve is opened and a constant-volume chamber outflow valve is closed with a longitudinal pressing member pressed against the scalp) of the actuator-inverted constant-volume ejection mechanism of FIG. 1.
Figure 4:
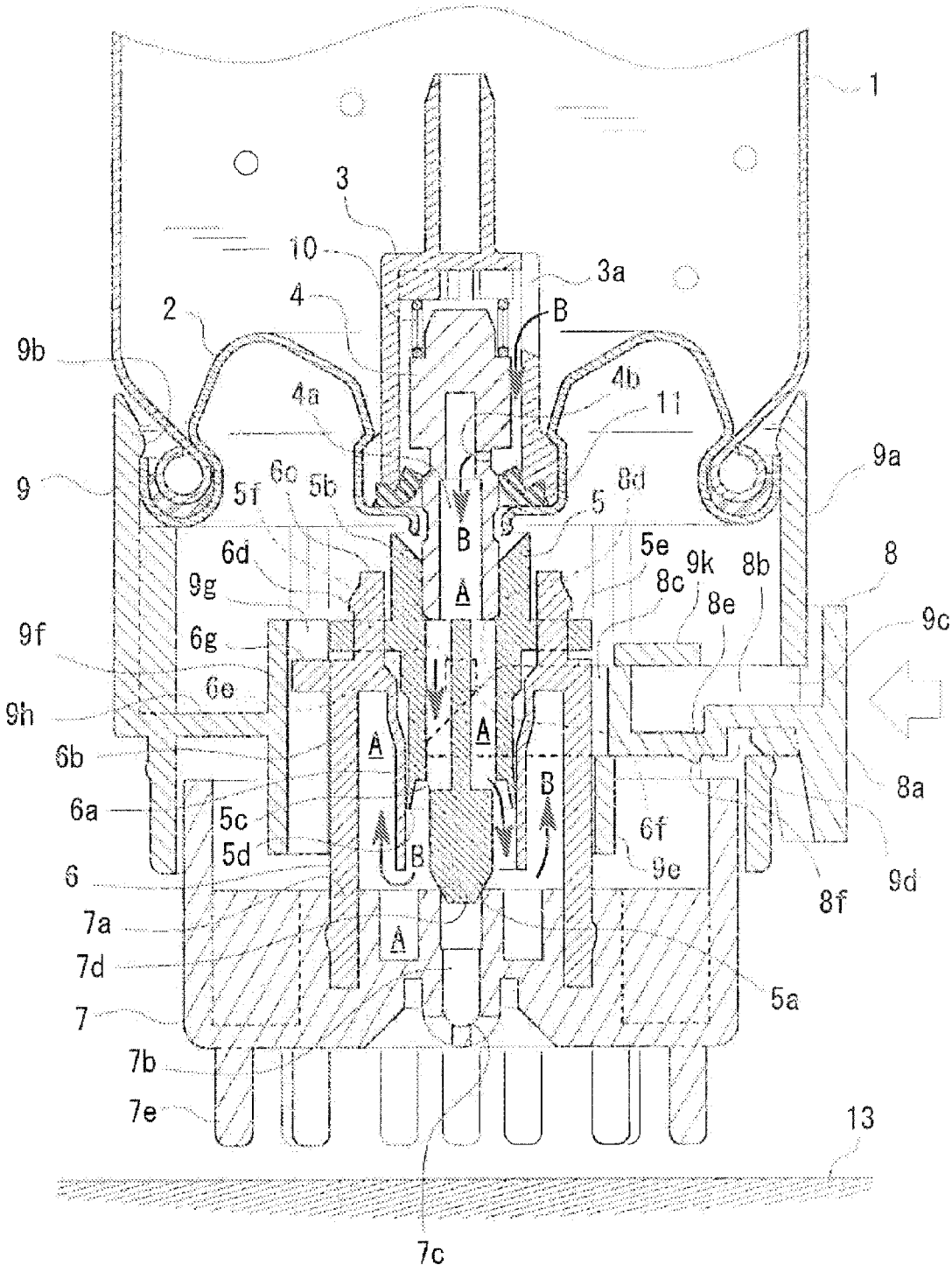
FIG. 4 is a representation of constant-volume chamber inflow mode (second constant-volume chamber inflow mode which produces a state where the constant-volume chamber inflow valve is opened and the constant-volume chamber outflow valve is closed with the lateral pushing member pushed toward a middle part of a container) of the actuator-inverted constant-volume ejection mechanism of FIG. 1.
Figure 5:
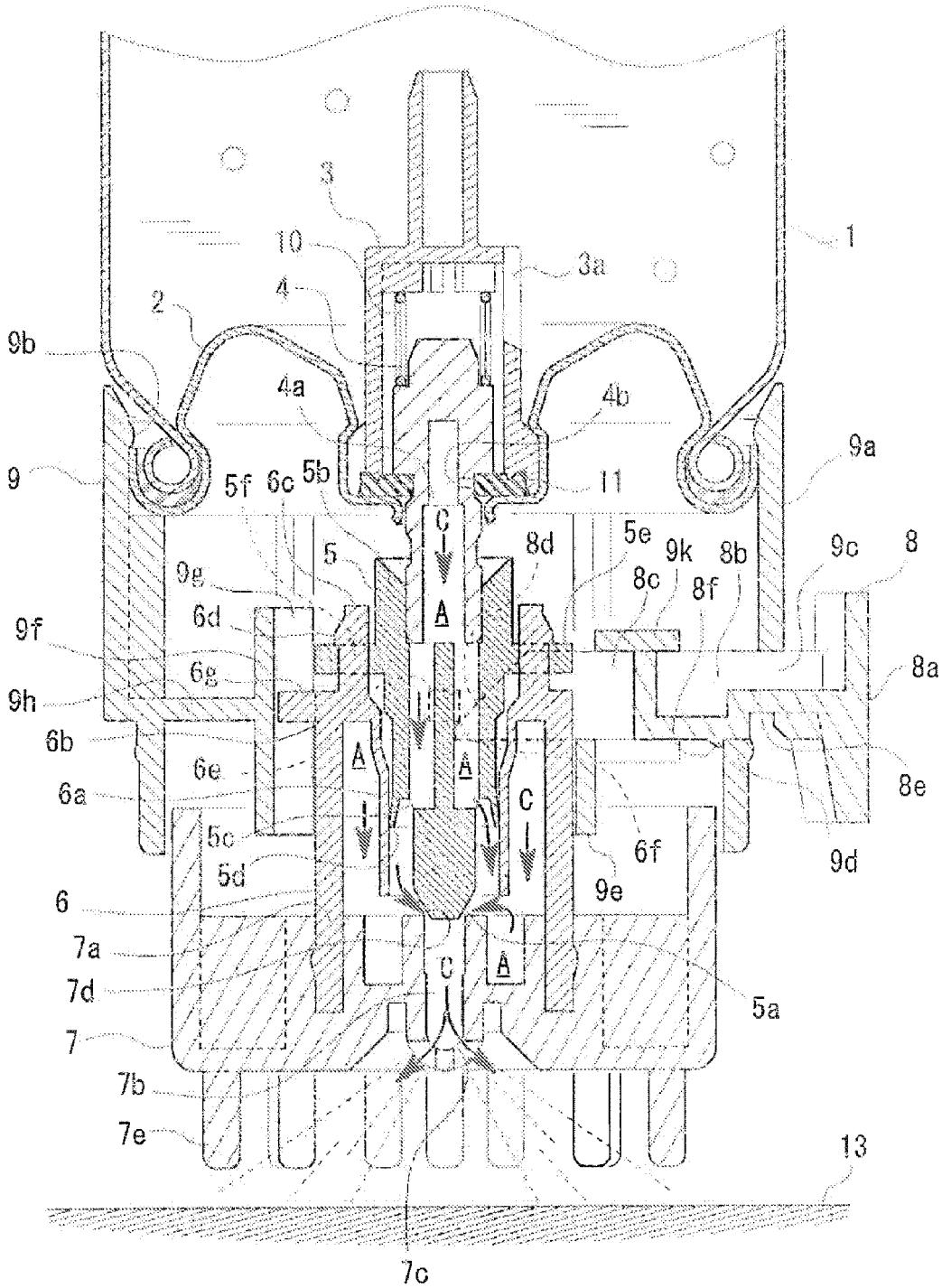
FIG. 5 is a representation of inverted constant-volume ejection mode (which produces a state where the constant-volume chamber inflow valve is closed and the constant-volume chamber outflow valve is opened with operation for pressing the longitudinal pressing member terminated) that follows the constant-volume chamber inflow mode of FIGS. 3 and 4.

In FIGS. 1 to 5, designated by A is a continuous space from an inflow valve to an outflow valve constituting a constant-volume chamber in which content to be ejected in a constant volume and liquefied gas are once stored, indicated by B is a state in which the content flows from a container body into the constant-volume chamber A (refer to FIGS. 3 and 4), and indicated by C is a state in which the content is ejected, from the constant-volume chamber A into an external space (refer to FIG. 5).

Also, designated by 1 is the container body of an aerosol-type product accommodating the content and ejecting gas which will be described later, designated by 2 is a mounting cap attached to an open end side of the container body 1, designated by 3 is the housing attached to a central portion of the mounting cap 2, designated by 3*a* is the cutout portion formed in part of a peripheral surface of the housing to serve as a content inflow portion during inverted constant-volume ejection, designated by 4 is a stem of which lower portion is disposed inside the housing 3, the stem 4 being biased in an upward direction when in an upright position by elastic action of a later-described conventional stem coil spring 10 and serving as a constant-volume chamber inflow valve together with a later-described conventional stem gasket 11, designated by 4*a* is an inner passage, and designated by 4*b* is a lateral hole portion constituting one side of the constant-volume chamber inflow valve.

Also, designated by 5 is a generally cylindrical valve member which is firmly fitted on a curved outside surface of an outlet side of the stem 4 and moves therewith in an interlocked fashion along a longitudinal (vertical) direction as illustrated, the valve member 5 serving as a constant-volume chamber outflow valve together with a later-described pressing member 7, designated by 5*a* is a central truncated conical portion constituting one side of the constant-volume chamber outflow valve, the central truncated conical portion 5*a* having a tapered outer peripheral surface, designated by 5*b* is a cylindrical portion constituting a lower portion of the valve member when in an upright position, the cylindrical portion 5*b* being firmly fitted on the curved outside surface of the outlet side of the stem 4, designated by 5*c* are a plurality of holes formed between the central truncated conical portion 5*a* and the cylindrical portion, the individual holes 5*c* serving as channels connected to the stem 4 for passing the container content (housing content), designated by 5*d* is an annular inverted skirt portion which goes into contact with a curved inside surface of a later-described lower cylindrical portion 6*a* to produce a sealing effect, the inverted skirt portion 5*d* defining the constant-volume chamber A, designated by 5*e* is an annular flange portion formed on a curved outside surface of the value member, and designated by 5*f* are a plurality of locking holes formed in the annular flange portion 5*e* for restricting a lowermost position of a later-described movable member 6 when in an inverted position relative to the valve member (refer to FIG. 5) in inverted constant-volume ejection mode.

Also, designated by 6 is the cylindrical movable member which can be moved up and down relative to the valve member 5, the movable member 6 defining the constant-volume chamber A, designated by 6*a* is an inner cylindrical portion with which the inverted skirt portion 5*d* comes into tight contact, designated by 6*b* is an outer cylindrical portion fitted in the later-described pressing member 7, designated by 6*c* are a plurality of legs fitted in the respective locking holes 5*f*, designated by 6*d* are raised portions forme don outside surfaces of the legs for preventing the legs 6*c* from coming off the locking holes 5*f* in the longitudinal direction, designated by 6*e* are a total of two driven parallelepipedic protrusions formed on a curved outside surface of the movable member at opposite locations separated by 180 degrees from each other along a circumferential direction, the driven parallelpipedic protrusions 6*e* serving to produce cam action together with a later-described pushing lever 8, designated by 6*f* are inverted-position lower edge portions of the driven parallelepipedic protrusions located on the side of a later-described operating surface 8*a*, and designated by 6*g* are antirotation protrusions formed at locations midway between the driven parallelpipedic protrusions 6*e* along the circumferential direction, the antirotation protrusions 6*g* serving to position the movable member along the circumferential direction.

Also, designated by 7 is the pressing member which is fixed to the outer cylindrical portion 6*b* of the movable member 6, defining the constant-volume chamber A, and constitutes the constant-volume chamber outflow valve together with the valve member 5, the pressing member 7 being of a needlepoint-holder-type having channels to the external space and movable along an upward/downward direction, designated by 7*a* is an annular groove 7*a* in which the outer cylindrical portion 6*b* is affixed, designated by 7*b* is a passage formed between the inside and outside of the pressing member, designated by 7*c* are a plurality of orifices formed on an outlet side of the passage for ejecting the content, designated by 7*d* is a circular edge portion at an inlet section of the passage, the circular edge portion 7*d* constituting the other side of the constant-volume chamber outflow valve by going into contact with and apart from the central truncated conical portion 5*a* of the valve member 5, and designated by 7*e* are a plurality of projections (needles) which go into contact with an ejection target area like later-described scalp 13, the projections 7*e* being formed on an outer surface side of the pressing member in such a manner as to surround the orifices 7*c* for ejecting the content.

Also, designated by 8 is the pushing lever which moves in a lateral direction toward a middle part of the container and thereby drives the pressing member 7 to a pushed position thereof as a result of pushing action performed by a user, designated by 8*a* is the operating surface provided on the outside of a later-described shoulder cover 9, designated by 8*b* is a generally rectangular basal portion which connects inward from the push-action operating surface, designated by 8*c* are a pair of straight arm portions individually extending inward from both widthwise ends of the basal portion, designated by 8*d* are slant surfaces formed at far end portions of the respective straight arm portions, the slant surfaces 8*d* serving to produce cam action by going into contact with the inverted-position lower edge portions of 6*f* the driven parallelepipedic protrusions 6*e*, designated by 8*e* is an arciform concave portion formed in an upright-position upper surface of the basal portion 8*b*, and designated by 8*f* is a raised portion formed on an upright-position upper surface on the inside of the arciform concave portion for restricting a retracted position of the pushing lever.

Figure 2:
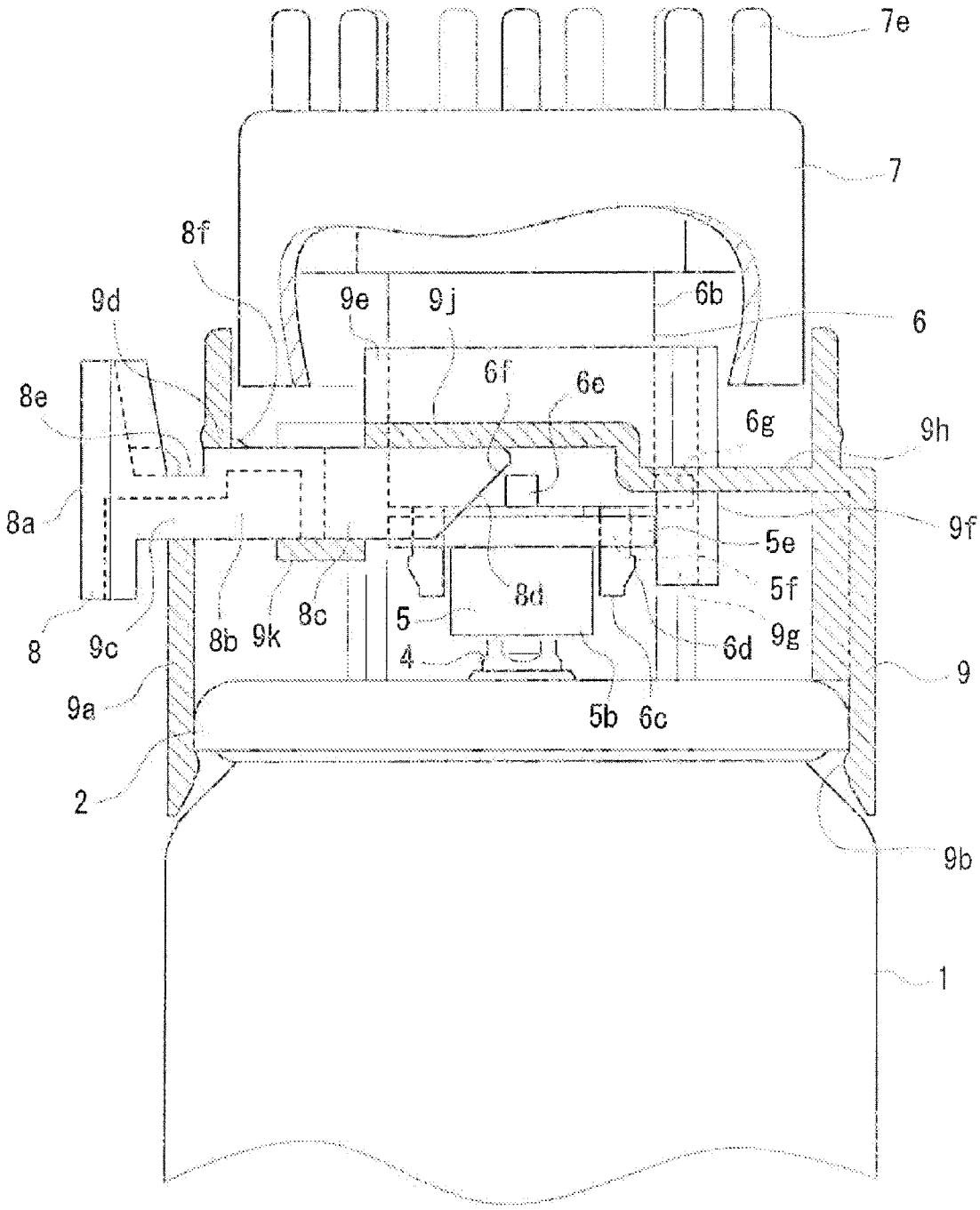
FIG. 2 is a representation of individual cam-action producing portions located between arm portions of a lateral pushing member and a curved outside surface of a cylindrical portion for forming a constant-volume chamber of the actuator-inverted constant-volume ejection mechanism of FIG. 1.

Also, designated by 9 is the shoulder cover which is fitted on an undercut part of the mounting cap 2 (i.e., an annular recessed part between an outer end portion of the mounting cap and the container body 1) and stays fixed to the container body 1 in either of constant-volume chamber inflow mode and inverted constant-volume ejection mode, designated by 9*a* is an outer cylindrical portion which is fitted on the mounting cap 2, designated by 9*b* is an annular swelling part formed on a curved inside surface of the outer cylindrical portion at a lower end thereof for fitting the outer cylindrical portion 9*a* on the mounting cap, designated by 9*c* is an opening formed in part of the outer cylindrical portion for passing the basal portion 8*b* of the pushing lever 8 and guiding the basal portion 8*b* to positions along the upward/downward direction and the lateral direction, designated by 9*d* is a position limiting part which is a carved inside surface portion located immediately above the opening when in the upright position for engaging with the raised portion 8*f* of the pushing lever 8 in a most retracted position thereof, designated by 9*e* is an inner cylindrical portion connected to the outer cylindrical portion 9*a* for guiding the movable member 6 along the upward/downward direction, designated by 9*f* is a longitudinally elongate portion located on a right side as illustrated in FIGS. 1 and 2, designated by 9*g* is a longitudinal groovelike portion formed in a curved inside surface portion of the longitudinally elongate portion along the longitudinal direction for guiding the inverted-position lower edge portions 6*f* of the movable member 6 and restricting rotation thereof, designated by 9*h* is an upright-position lower-side connecting portion, formed between the outer cylindrical portion 9*a* and the longitudinally elongate portion 9*f*, designated by 9*j* are a pair of flat platelike upright-position upper-side connecting portions formed in such a manner as to extend from both sides of the upright-position lower-side connecting portion along the same direction as the respective straight arm portions 8*c* for guiding upright-position upper surfaces of the respective straight arm portions, and designated by 9*k* is a shelf-surface guide portion which is, so to speak, part of a hanging shelf section formed between opposed parts of the upright-position upper-side connecting portions located on a left side as illustrated in FIGS. 1 and 2 for guiding the basal portion 8*b* and the straight arm portions 8*c* of the pushing lever 8 to respective positions along the lateral direction, the shelf-surface guide portion 9*k* having a flat platelike shape extending along the vertical direction as illustrated to guide upright-position lower surfaces of the respective straight arm portions 8*c*.

Also, designated by 10 is the stem coil spring disposed inside the housing 3 for biasing the stem 4 in the upward direction, designated by 11 is the stem gasket disposed between an inside surface of the mounting cap 2 at an inner end portion thereof and an upright-position upper end portion of the housing 3 in such a manner as to close off the lateral hole portion 4*b* of the stem 4 in stationary mode, the stem gasket 11 constituting the other side of the constant-volume chamber inflow valve, designated by 12 is a top cap having a detachable shape and attached to the arciform concave portion 8*e* of the pushing lever 8 and to the outer cylindrical portion 9*a* of the shoulder cover 9, and designated by 13 is the scalp which is a constant-volume ejection target area.

Here, elements like the housing 3, the stem 4, the valve member 5, the movable member 6, the pressing member 7, the pushing lever 8, the shoulder cover 9 and the top cap 12 are plastic members made of such materials as polypropylene polyethylene, polyacetal, nylon or polybutylene terephthalate.

Also, the container body 1 and the mounting cap 2 are metallic members. Further, the stem coil spring 10 is a metallic or plastic member and the stem gasket 11 is a rubber member.

Basic features of the actuator-inverted, constant-volume ejection mechanism of FIGS. 1 to 5 are as follows:

(11) the actuator-inverted constant-volume ejection mechanism uses as an inverted constant-volume ejecting part not only the pressing member 7 movable along the longitudinal direction, the pressing member 7 having a plurality of projections 7*e* like needles of a needlepoint holder that are formed thereon and are pressed against the scalp 13, for example, but also

(12) the pushing lever 6 movable along the lateral direction for driving the pressing member 7 in a pressed direction thereof.

In the stationary mode depicted in FIGS. 1 and 2, the stem 4 moves upward due to an elastic force of the stem coil spring 10 as in an ordinary aerosol-type product so that the lateral hole portion 4*b* of the stem is closed by the stem gasket 11. This means that the constant-volume chamber inflow valve is in a "closed" state.

At this time, the movable member 6 and the pressing member 7 which is integrally assembled with the movable member 6 are in a state in which the circular edge portion 7*d* at an inlet side of the passage 7*b* of the pressing member 7 is in contact with the central truncated conical portion 5*a* of the valve member 5. This means that the constant-volume chamber outflow valve is set in an open state.

Also, there can be a case where the constant-volume chamber outflow valve is set to the open state in accordance with the amount of opening of the constant-volume chamber outflow valve (=a gap between the central truncated conical portion 5*a* and the circular edge portion 7*d*) in the inverted constant-volume ejection mode in a preceding ejecting operation (refer to FIG. 4) and the magnitude of a friction force between the curved inside surface of the inner cylindrical portion 6*a* of the movable member 6 and the inverted skirt portion 5*d* of the valve member 5. In actuality, however, the distance between the central truncated conical portion 5*a* and the circular edge portion 7*d* is approximately 0.1 mm only at this time.

Meanwhile, it is needless to say that the constant-volume chamber outflow valve is in the "open" state in the stationary mode of the actuator-inverted constant-volume ejection mechanism using the aforementioned operating button coil spring.

The constant-volume chamber inflow mode of FIG. 3 depicts a situation in which the user holding the container body 1 presses the projections 7*e* of the pressing member 7 against the scalp 13, causing the container body and the shoulder cover 9 assembled integrally therewith to move downward in the inverted position relative to the stem 4, the valve member 5, the movable member 6 and the pressing member 7.

As seen from a relative point of view, the constant-volume chamber inflow mode of FIG. 3 may be regarded as a situation where the stem 4, the valve member 5, the movable member 6 and the pressing member 7 have moved upward relative to the container body 1 in the inverted position.

The constant-volume chamber inflow mode of FIG. 4 depicts a situation in which the user pushes the operating surface 3*a* of the pushing lever 8 inward in an arrow direction as illustrated and, as a consequence, the cam action produced between the slant surfaces 8*d* of the respective straight arm portions 8*c* of the pushing lever and the inverted-position lower edge portions 6*f* of the respective driven parallelepipedic protrusions 6*e* of the movable member 6 has caused the movable member and the pressing member 7 assembled integrally therewith to move upward in the inverted position.

In either of cases of the constant-volume chamber inflow mode depicted in FIGS. 3 and 4, movements on the actuator side can be expressed as follows in terms of a relationship among relative positions referenced to the container body 1:

(21) a single structure including the movable member 6 and the pressing member 7 moves upward in the inverted position;

(22) owing to this movement, the constant-volume chamber outflow valve which has provisionally been in the open state so far as mentioned above is also set to a closed state with the circular edge portion 7*d* of the pressing member 7 going into contact with central truncated conical portion 5*a* of the valve member 5 in a reliable fashion;

(23) the valve member 5 and the stem 4 assembled integrally therewith move upward in the inverted position together with the pressing member 7 through the constant-volume chamber outflow valve which is in the closed state subsequently; and

(24) as a result of this movement of the stem 4, an internal space of the stem gasket 11 provided on an inlet side of the lateral hole portion 4*b* becomes deformed, thereby breaking the seal between the stem 4 and the stem gasket 11, that is to say, causing the constant-volume chamber inflow valve which has so far been closed to shift to an open state.

Simply expressed, the actuator side is shifted to a state in which the constant-volume chamber inflow valve is opened and the constant-volume chamber outflow valve is closed in the constant-volume chamber inflow mode of FIGS. 3 and 4.

Therefore, the content of the container body 1 in the inverted position depicted in FIGS. 3 and 4 and ejecting liquefied gas flow into the constant-volume chamber A and stored therein through "the cutout portion 3*a* of the housing 3, an annular space between a curved inside surface of the housing 3 and the curved outside surface of the stem 4, the lateral hole portion 4*b* of the stem 4, the inner passage 4*a* of the stem 4, an internal space of the valve member 5 and the holes 5*c* of the valve member 5 in this order" as indicated by arrows B.

Incidentally, the aforementioned situation (22) where "the constant-volume chamber outflow valve which has provisionally been in the open state so far as mentioned above is also set to a closed state with the circular edge portion 7*d* of the pressing member 7 going into contact with central truncated conical portion 5*a* of the valve member 5 in a reliable fashion" is created because the pressing member 7 and the movable member 6 assembled integrally therewith relatively move in relation to the valve member 5, overwhelming the friction force between the curved inside surface of the inner cylindrical portion 6*a* and the inverted skirt portion 5*d*.

Depicted in the inverted constant-volume ejection mode of FIG. 5 is a mode in which operation performed on the pressing member 7 of FIG. 3 to press the same against the scalp 13 or operation performed on the pushing lever 8 of FIG. 4 to push the same inward into the container has been terminated to eject the content of the constant-volume chamber A into the external space, that is, a state in which the constant-volume chamber inflow valve is closed and the constant-volume chamber outflow valve is opened.

Incidentally, in a case where both the operation for pressing the pressing member 7 and the operation for pushing the pushing lever 8 are currently performed, the ejection mechanism shifts to the inverted constant-volume ejection mode only when both of these operations are terminated.

In the inverted constant-volume ejection mode of FIG. 5,

(31) the stem 4 and the valve member 5 assembled integrally therewith return to stationary mode positions depicted in FIG. 1 by moving downward due to the elastic force of the stem coil spring 10 and the lateral hole portion 4*b* of the stem 4 is closed by the stem gasket 11 as in an ordinary aerosol-type product;

(32) the movable member 6 and the pressing member 7 assembled integrally therewith move downward relative to the valve member 5 (stem 4) due to their own weights and a downward-oriented pressure of the content of the constant-volume chamber A (pressure of the liquefied gas), so that the circular edge portion 7*d* of the pressing member is separated from the central truncated conical portion 5*a* of the valve member; and

(33) lowermost positions of the movable member 6 and the pressing member 7 relative to the valve member 5 are defined at positions where the raised portions 6*d* of the movable member go into contact with the annular flange portion 5*e* of the valve member.

When the ejection mechanism shifts to the inverted constant-volume ejection mode in the state in which the constant-volume chamber inflow valve is closed and the constant-volume chamber outflow valve is opened in the aforementioned manner, the content of the constant-volume chamber A is ejected into the external space through "a space of a gap between the central truncated conical portion 5*a* of the valve member 5 and the circular edge portion 7*d* of the pressing member 7, the passage 7*b* and the plurality of orifices 7*c*" as indicated by arrows C in FIG. 5 due to action of the liquefied gas.

When the ejection mechanism is used in the inverted position, the movable member 6 and the pressing member 7 move downward relative to the valve member 5 due to an effect of the pressure of the content of the constant-volume chamber A (an effect of the pressure of the liquefied gas). This is because a pressure oriented downward as illustrated acts on a ceiling portion of the pressing member defining the constant-volume chamber and the weights of the movable member 6 and the pressing member 7 act downward.

In the actuator-inverted constant-volume ejection mechanism illustrated, the constant-volume chamber outflow valve is set to the "open" state by the pressure itself of the content of the constant-volume chamber without the provision of the aforementioned operating button coil spring 23 for opening the constant-volume chamber outflow valve as described above.

Therefore, the number of components of the constant-volume ejection mechanism is reduced by as much as this operating button coil spring and it becomes correspondingly easier to perform operations for setting the pressing member 7 and the pushing lever 8 to the constant-volume chamber inflow mode.

To enable operations in the constant-volume chamber inflow mode and the inverted constant-volume ejection mode, it is necessary that, as regards the pressure of the content of the constant-volume chamber A:

(41) a load applied by the pressure to the stem 4 and the valve member 5 in the upward direction in the inverted position in the constant-volume chamber inflow mode be smaller than a biasing force (e.g., 2.0 kgf) exerted by the pushing lever 8 in the downward direction in the inverted position; and

(42) a combination of forces exerted by a load applied by the pressure to the movable member 6 and the pressing member 7 in the downward direction in the inverted position and the weights of the movable member and the pressing member in the inverted constant-volume ejection mode be larger than the friction force acting between the inverted shirt portion 5*d* and the curved inside surface of the lower cylindrical portion 6*a* in the upward direction in the inverted position.

This is because if the aforementioned requirement (41) is not satisfied, for example, the valve member 5 and the pressing member 7 move in directions in which these members 5 and 7 are relatively separated from each other due to the effect of the pressure of the stored content, potentially creating a situation where the content is continuously ejected in an ordinary fashion.

The aforementioned load applied by the pressure of the content of the constant-volume chamber A is set to a value of 0.3 to 1.5 kgf, for example. It is to be noted however that this value is merely exemplary and the load may be set to an arbitrary value that satisfies the aforementioned requirements (41) and (42).

The actuator-inverted constant-volume election mechanism illustrated is assembled generally by the below-described procedure:

(51) the outer cylindrical portion 6*b* of the movable member 6 is fitted in the annular groove 7*a* of the pressing member 7;

(52) the valve member 5 is inserted into an inner space of the inner cylindrical portion 6*a* and the locking holes 5*f* are pushed beyond the raised portions 6*d* of the legs 6*c* for preventing the legs 6*c* from coming off along the longitudinal direction so that the valve member will not come off the inner cylindrical portion;

(53) the pushing lever 8 is inserted into the opening 9*c* until the raised portion 8*f* of the pushing lever 8 goes into the inside of the position limiting part 9*d* of the shoulder cover 9;

(54) the movable member 6 assembled as mentioned in point (52) above is fitted into the inner cylindrical portion 9*e* of the shoulder cover 9 assembled as mentioned in point (53) above from a top side while matching the antirotation protrusions 6*g* with the longitudinal groovelike portion 9*g*; and

(55) the top cap 12 is attached to the outer cylindrical portion 9*a* of the shoulder cover 9.

The movable member 6, the pushing lever 8 and the shoulder cover 9 are made of plastic. Therefore, these members 6, 8, 9 individually deform in a range in which the members can elastically restore their original shapes during a fitting process mentioned in point (54) above, so that the straight arm portions 8*c*, the inner cylindrical portion 9*e* and the upright-position upper-side connecting portions 9*j* in which the driven parallelepipedic protrusions 6*e* on the movable member 6 are fitted can slide over the driven parallelepipedic protrusions 6*e*.

Needless to say, the present invention is not limited to the illustrated actuator-inverted constant-volume ejection mechanism, but the pressing member 7 may be configured as an operating member of a tilt type and not of a longitudinally moving type.

Aerosol-type products to which the invention is applied include products for various applications such as those for an air freshener, a detergent, a cleaning agent, an antiperspirant, a coolant, an anti-inflammatory agent, a hair styling agent, a hair treatment, agent, a hair dye, a hair tonic, cosmetics, shaving foam, a food, a liquid droplet product (e.g., vitamin), a medical supply, a nonmedicinal product, paint, a horticultural agent, a pesticide (insect repellent), a cleaner, laundry starch, urethane foam, a fire extinguisher, a bonding agent and a lubricant.

The content to be accommodated in the container body may be of any of various forms, such as liquid, cream or gel types. Additionally, ingredients that may be mixed in the content may be products like powders, oil components, alcohols, surfactants, high molecular compounds, any of components effective for individual applications and water, for example.

The powders that may be used are a metal salt powder, an inorganic powder, a resin powder and the like. The usable powder products include talc, kaolin, aluminum hydroxychloride (aluminum salt), calcium alginate, gold dust, silver dust, mica, carbonate, barium, sulfate, cellulose, and a mixture thereof, for example.

The oil components that may be used include silicone oil, palm oil, eucalyptus oil, camellia oil, olive oil, jojoba oil, paraffin oil, myristic acid, palmitic acid, stearic acid, linoleic acid and linolenic acid, for example.

The alcohols that may be used include monohydric lower alcohols like ethanol, monohydric higher alcohols like lauryl alcohol, and polyalcohols like ethylene glycol, glycerin and 1,3-butylene glycol, for example.

The surfactants that may be used include an anionic surfactant like sodium lauryl sulfate, a nonionic detergent like polyoxyethyleneoleyl ether, an amphoteric surfactant like lauryl dimethyl aminoacetic acid betaine, and a cationic surfactant like alkyl trimethyl ammonium chloride, for example.

The high molecular compounds that may be used include methyl cellulose, gelatin, starch, casein, hydroxyethyl cellulose, xanthan gum and carboxyvinyl polymer, for example.

The components effective for individual applications that may be used include anti-inflammatory analgesics like methyl salicylate and indomethacin, sterilization chemicals like sodium benzoate and cresol, insect repellents like pyrethroid and diethyltoluamide, an antiperspirant like zinc oxide, refreshments like camphor and menthol, antiasthmatic drugs like ephedrine and adrenaline, sweeteners like sucralose and aspartame, bonding agents and paints like epoxy resin and urethane, dyes like paraphenylenediamine and aminophenol, and fire extinguishing compositions like ammonium dihydrogen phosphate and sodium/potassium bicarbonate, for example.

Furthermore, it is possible to use, besides the aforementioned contents, a suspending agent, an ultraviolet absorber, an emulsifier, a moisturizing agent, an antioxidant and a sequestering agent, for example.

The ejecting gas that may be used include liquefied gases like liquefied petroleum gas, dimethyl ether and fluorocarbon as well as soluble compressed gas (e.g., carbon dioxide gas or nitrous oxide).

DESCRIPTION OF THE SYMBOLS (A to 13 mentioned below are used in FIGS. 1 to 5.)

A: Constant-volume chamber

B: State in which content flows from container body into constant-volume chamber (refer to FIGS. 3 and 4)

C: State in which content is ejected from constant-volume chamber into external space (refer to FIG. 5)

1: Container body of aerosol-type product

2: Mounting cap

3: housing

3*a*: Cutout portion

4: Stem

4*a*: Inner passage

4*b*: Lateral hole portion

5: Valve member for passing content

5*a*: Central truncated conical portion having tapered outer peripheral surface

5*b*: Cylindrical portion

5*c*: Holes

5*d*: Inverted skirt portion

5*e*: Annular flange portion

5*f*: Locking holes

6: Movable member

6*a*: Inner cylindrical portion

6*b*: Outer cylindrical portion

6*c*: Plurality of legs

6*d*: Raised portions for preventing legs from coming off in the longitudinal direction

6*e*: A total of two driven parallelepipedic protrusions

6*f*: Inverted-position lower edge portions

6*g*: Antirotation protrusions

7: Pressing member

7*a*: Annular groove

7*b*: Passage

7*c*: Orifices

7*d*: Circular edge portion

7*e*: Projections (needles)

8: Pushing lever

8*a*: Operating surface

8*b*: Basal portion

8*c*: Pair of straight arm portions

8*d*: Slant surfaces

8*e*: Arciform concave portion

8*f*: Raised portion for restricting a retracted position of pushing lever

9: Shoulder cover

9*a*: Outer cylindrical portion

9*b*: Annular swelling part for fitting on the mounting cap

9*c*: Opening

9*d*: Position limiting part

9*e*: Inner cylindrical portion

9*f*: Longitudinally elongate portion

9*g*: Longitudinal groovelike portion

9*h*: Upright-position lower-side connecting portion

9*j*: Upright-position upper-side connecting portions

9*k*: Shelf-surface guide portion

10: Stem coil spring

11: Stem gasket

12: Top cap

Figure 6:
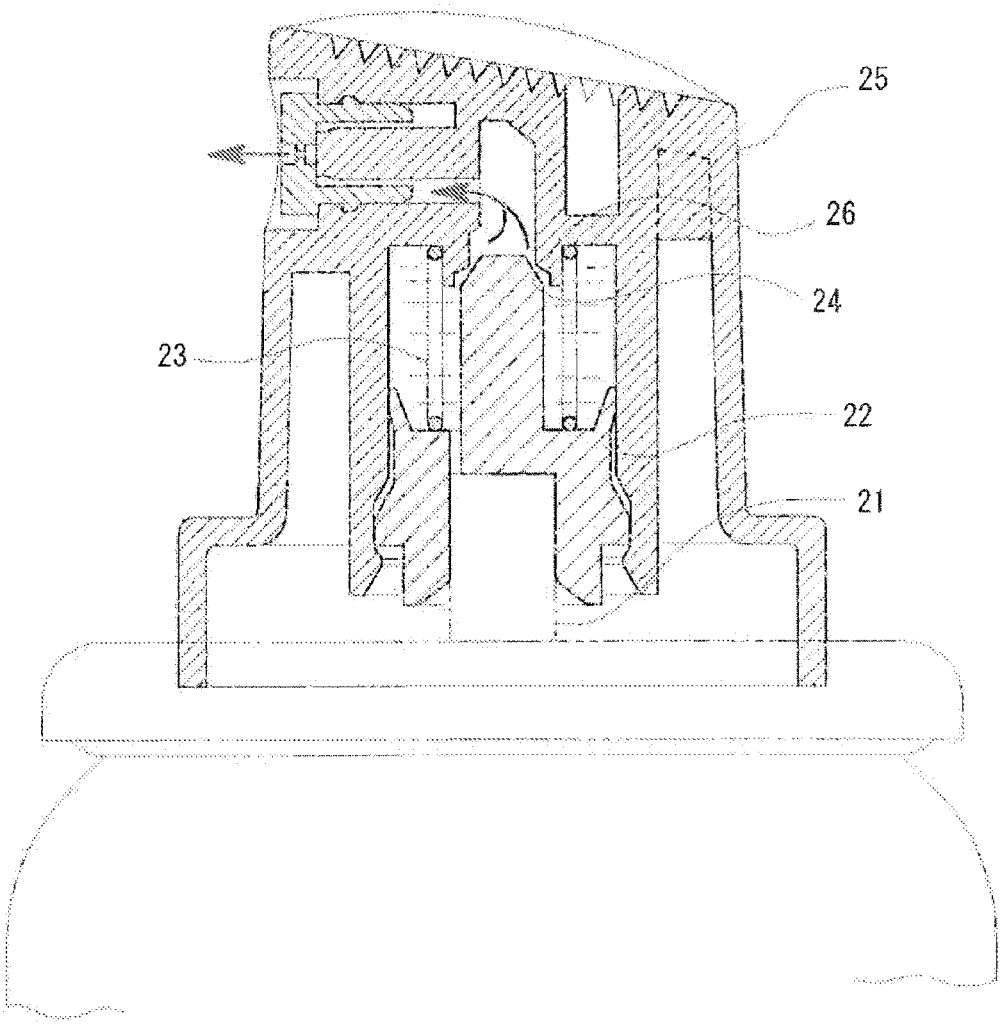
FIG. 6 PRIOR ART
FIG. 6 is a representation of an actuator constant-volume ejection mechanism already proposed by the applicant.

13: Scalp (21 to 26 mentioned below are used in FIG. 6.)

21: Stem

22: Valve seat portion (corresponds to valve member of this invention)

23: Operating button coil spring

24: Annular valve seat

25: Operating button body (corresponds to pressing member and movable member of this invention)

26: Annular valve element

The invention claimed is:

1. An actuator-inverted constant-volume ejection mechanism comprising:

a stem which serves a function of a constant-volume chamber inflow valve, the stem being biased by an elastic force in a first direction toward a stationary mode position in an aerosol container;

a valve member which serves the function of a constant-volume chamber outflow valve, the valve member being fixed to the stem;

a longitudinal pressing member attached to the valve member in such a manner that the longitudinal pressing member can move in the first direction and a second direction which is opposite to the first direction, the longitudinal pressing member serving the function of the constant-volume chamber outflow valve together with the valve member, and the longitudinal pressing member having a plurality of projections like needles of a needlepoint holder that are pressed against an ejection target area, an ejection passage to an external space and a constant-volume-chamber-forming cylindrical portion;

a lateral pushing member for driving the longitudinal pressing member in the second direction;

a constant-volume chamber defined by the stem, the valve member and the longitudinal pressing member for accommodating a content;

a valve-action producing portion which is part of the stem constituting the constant-volume chamber inflow valve which shifts to an open state in which the content of a container body flows into the constant-volume chamber with the stem moving in the second direction, overwhelming the elastic force, as a result of an ejecting action performed on either of the longitudinal pressing member and the lateral pushing member, and is kept in a closed state by an effect of the elastic force biasing the stem in the first direction when the ejecting action is not performed on either of the longitudinal pressing member and the lateral pushing member;

a valve-action producing portion located between the valve member and the longitudinal pressing member, the valve-action producing portion constituting the constant-volume chamber outflow valve which stays in a closed state as a result of a movement of the longitudinal pressing member in the second direction caused by the ejecting action performed on either of the longitudinal pressing member and the lateral pushing member, and shifts to an open state in which the content of the constant-volume chamber is caused to flow into the ejection passage by a force exerted on the longitudinal pressing member in the first direction after the ejecting action has been terminated.

2. The actuator-inverted constant-volume ejection mechanism according to claim 1, wherein the longitudinal pressing member includes at least a pair of first cam-action producing portions on a curved outside surface of the constant-volume-chamber-forming cylindrical portion, the pair of first cam-action producing portions being configured to be driven in the second direction as a result of a movement of the lateral pushing member caused by the ejecting action, and the lateral pushing member includes second cam-action producing portions formed in the form of at least a pair of arm portions that go into contact with the first cam-action producing portions when the ejecting action is performed.

3. The actuator-inverted constant-volume ejection mechanism according to claim 1, further comprising a shoulder cover which remains attached to the container body even when the ejecting action is performed, the shoulder cover including a guide portion for guiding the lateral pushing member along a lateral direction when the ejecting action is performed.

4. The actuator-inverted constant-volume ejection mechanism according to claim 1 wherein the force exerted on the longitudinal pressing member in the first direction is produced by a pressure of ejecting gas accommodated in the constant-volume chamber.

5. The actuator-inverted constant-volume ejection mechanism according to claim 1, further comprising a housing attached to the container body to serve as an upstream space of the constant-volume chamber inflow valve for accommodating a lower portion of the stem and a member for producing the elastic force, the housing having an opening in a peripheral surface through, which the content flows into the housing when the container is in an inverted position.

6. An aerosol-type product comprising the actuator-inverted constant-volume ejection mechanism according to claim 1 and accommodating a pressurizing agent and content.

* * * * *